US007441390B2

(12) United States Patent
Lopparelli et al.

(10) Patent No.: US 7,441,390 B2
(45) **Date of Patent: *Oct. 28, 2008**

(54) DEVICE FOR FORMING CONTAINERS PRODUCED CONTINUOUSLY FROM A TUBULAR WRAPPER AND UNIT FOR PACKAGING THE CONTAINERS

(75) Inventors: Lucio Lopparelli, Foligno (IT); Umberto Gatti, S. Egidio (IT)

(73) Assignee: IPI S.R.L., Perugia (IT)

( * ) Notice: Subject to any disclaimer, the term of this patent is extended or adjusted under 35 U.S.C. 154(b) by 47 days.

This patent is subject to a terminal disclaimer.

(21) Appl. No.: 11/596,257

(22) PCT Filed: Apr. 13, 2005

(86) PCT No.: PCT/IT2005/000208

§ 371 (c)(1),
(2), (4) Date: Nov. 13, 2006

(87) PCT Pub. No.: WO2005/110856

PCT Pub. Date: Nov. 24, 2005

(65) Prior Publication Data

US 2008/0041024 A1 Feb. 21, 2008

(30) Foreign Application Priority Data

May 13, 2004 (IT) ..... RM2004A0235

(51) Int. Cl.
*B65B 9/06* (2006.01)
*B65B 9/20* (2006.01)
*B65B 51/30* (2006.01)

(52) U.S. Cl. ..... 53/551; 53/374.6

(58) Field of Classification Search ..... 53/551, 53/374.3, 374.5, 374.6, 375.4; *B65B 51/30*
See application file for complete search history.

(56) References Cited

U.S. PATENT DOCUMENTS 3,320,718 A * 5/1967 Thesing ..... 53/551
3,849,965 A * 11/1974 Dominici ..... 53/551
4,109,792 A 8/1978 Greenawalt et al.
4,305,240 A * 12/1981 Grevich et al. ..... 53/374.6
4,483,126 A * 11/1984 Henry ..... 53/551

(Continued)

FOREIGN PATENT DOCUMENTS

EP 1 125 847 A 8/2001

(Continued)

*Primary Examiner*—Stephen F Gerrity
(74) *Attorney, Agent, or Firm*—Arent Fox LLP

(57) ABSTRACT

A device (8) for forming containers (2) produced continuously from a tubular wrapper (3) fed along a substantially vertical direction of advance (A). The device has at least one support carriage (8*a*) movable along a respective closed path having at least one active segment parallel to the direction of advance (A). The carriage (8*a*) supports a sealing base (11) able to be associated to a first lateral face of the tubular wrapper (3) at a sealing region (Z) of the wrapper (3). A contrasting element (14) is removably associated to the support carriage (8*a*) and movable between a first closed position in which it approaches the base (11) and abuts against a second lateral face of the tubular wrapper (3) opposite to the first lateral face at the sealing region (Z), and a second position in which it is movable away from the base (11).

26 Claims, 13 Drawing Sheets

U.S. PATENT DOCUMENTS

| | | | | |
|---|---|---|---|---|
| 4,614,078 | A * | 9/1986 | Kawabe | 53/551 |
| 4,663,916 | A | 5/1987 | Ohlsson et al. | |
| 5,220,771 | A * | 6/1993 | Burns | 53/551 |
| 6,810,644 | B2 * | 11/2004 | Palm | 53/450 |

FOREIGN PATENT DOCUMENTS

| | | | |
|---|---|---|---|
| EP | 1234772 | A1 * | 8/2002 |

* cited by examiner

DEVICE FOR FORMING CONTAINERS PRODUCED CONTINUOUSLY FROM A TUBULAR WRAPPER AND UNIT FOR PACKAGING THE CONTAINERS

CROSS REFERENCE TO RELATED APPLICATION

This application is a National Stage entry of International Application Number PCT/IT2005/000208, filed Apr. 13, 2005, and claims priority of Application Number RM2004A000235 filed May 13, 2004, in Italy. The disclosures of the prior applications are hereby incorporated herein in their entirety by reference.

TECHNICAL FIELD

The present invention relates to a device for forming containers produced continuously from a tubular wrapper fed along a substantially vertical direction of advance. The present invention further relates to a unit for packaging the aforesaid containers in which the forming device finds advantageous use.

BACKGROUND ART

The invention is in the sector of packaging containers of incoherent material, generally containers of liquids for human consumption. Such containers are produced in continuous fashion from a tubular wrapper fed along a substantially vertical direction. The tubular wrapper is filled with incoherent material and subsequently sealed and cut along transversal seal lines which define the individual containers.

As is well known, the wrapper material, generally constituted by heat-sealable paper material, is continuously unwound from a reel towards a folding device adapted to join opposite longitudinal edges of the wrapper to each other. The tubular wrapper is then advanced along a vertical path through a filling unit. The filling unit delivers the incoherent material inside the tubular wrapper through an upper opening of the tubular wrapper. Downstream of the filling unit is a forming device provided with heated bars adapted to perform a series of seals, transverse to the longitudinal axis of the tubular wrapper. The heated bars are mounted on a fixed support structure and are movable only to approach each other. In this way, the container containing the incoherent material is defined between two consecutive seal lines. Lastly, a cutting member positioned downstream of the forming device separates the containers from each other by a transverse cut along the seal line.

The known packaging units described above have important drawbacks, which are linked mainly to the forming device.

It should be noted that the heated bars are positioned at opposite sides of the tubular wrapper and movable to approach each other to press the region to be sealed along a transverse direction to the direction of vertical motion of the tubular wrapper. Because of the movement of the bars, the tubular wrapper is braked intermittently, causing considerable damage to the seal region. During the motion of the wrapper, the bars slide on the wrapper causing incorrect seals and the damage to the sealed area.

The prior art discloses devices able to overcome the aforementioned problems by providing bars movable along the path of the tubular wrapper.

As is described for example in European patent EP1125847, the forming device provided with movable bars is constituted by two adjacent support frames having respective belts movable along a closed path. The tubular wrapper is actuated through the belts, at a rectilinear segment of the closed path, parallel to the direction of actuation of the wrapper. Each belt bears a plurality of carriages which are movable along the path. Each carriage bears a heated bar adapted to abut on the surface to be heated of the tubular wrapper. In this situation, when the carriages are positioned at the rectilinear segment, the bars of each pair of carriages abut against each other pressing the region to be sealed of the tubular wrapper. The pressing operation is then performed while each pair of carriages is maintained in motion along the direction of actuation of the tubular wrapper. The device described above has important drawbacks, although it solves the problem of avoiding any relative sliding between the bars and the wrapper.

These drawbacks are linked mainly to the structural complexity of the sealing device and of the overall size presented thereby. It should be noted that the structure constituted by two frames, each of which has a belt, is very bulky, further considering that each belt has respective motion transmission member. Moreover, it should be considered that each pair of carriages must necessarily be in synchrony during the sealing operation to make the pressing between one bar and the other efficient. To maintain the correct positioning of the carriages, electronic means are provided for controlling and adjusting. Such means are sometimes highly complex and have an excessive cost of construction. Consequently, the presence of means for controlling and adjusting the belts causes high costs for the production and/or commercialisation of the known devices.

SUMMARY OF INVENTION

An object of the present invention is to solve the problems noted in the prior art by proposing a forming device and a unit for packaging containers able to solve the aforementioned drawbacks of the prior art.

In detail, the object of the present invention is to provide a device for forming containers having a simple, economical, reliable structure, with small size which is able to seal tubular wrapper following the advancing path of the wrapper.

BRIEF DESCRIPTION OF THE DRAWINGS

Further characteristics and advantages shall become more readily apparent from the detailed description of a preferred, but not exclusive, embodiment of a forming device and a unit for packaging containers, in accordance with the present invention. This description shall now be provided below with reference to the accompanying figures, provided purely by way of non limiting indication, in which.

DETAILED DESCRIPTION OF THE INVENTION

Figure 1:
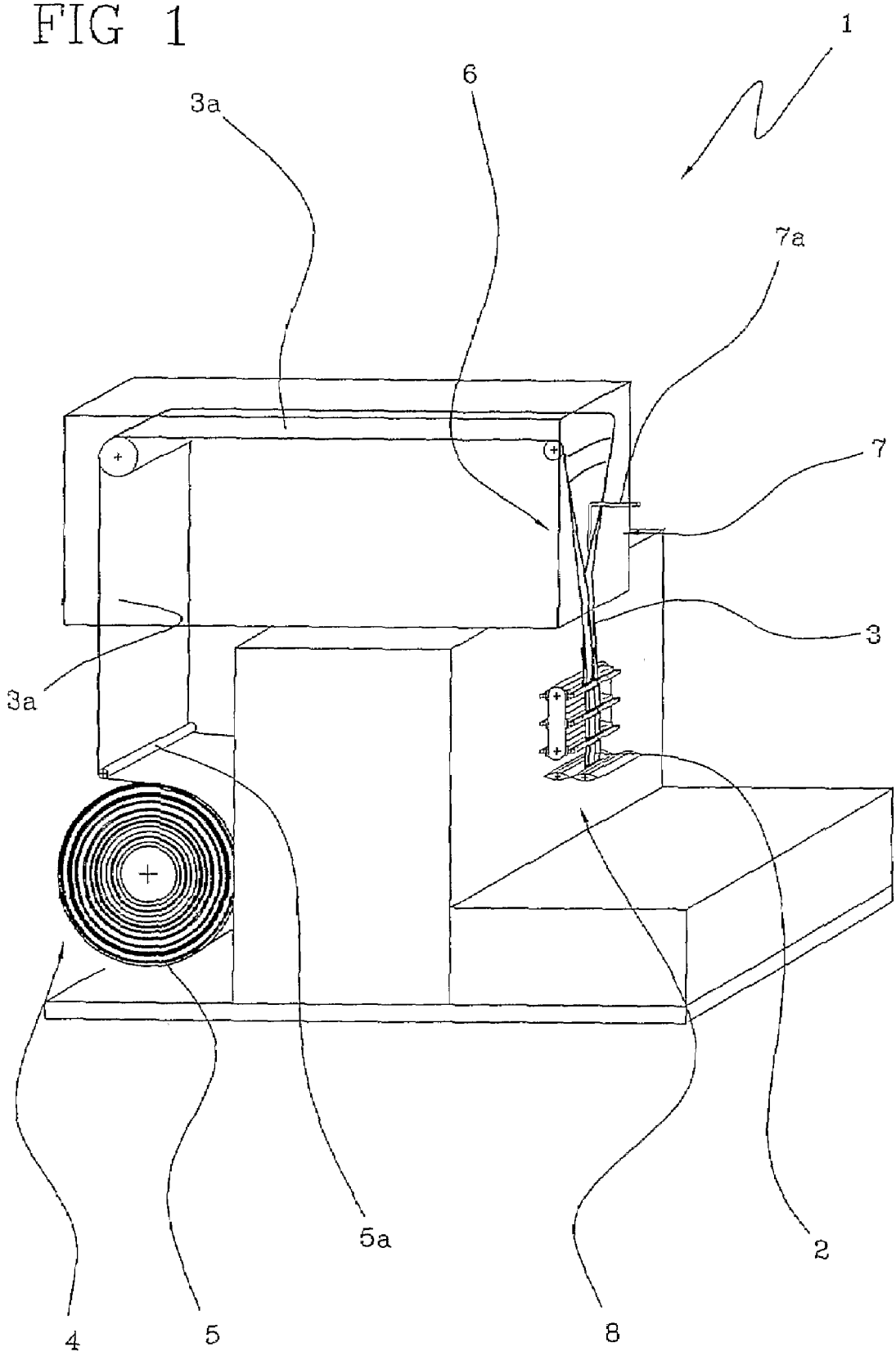
FIG. 1 shows a schematic perspective representation of a unit for packaging containers produced continuously from a tubular wrapper with some parts removed to better show others.

With reference to the accompanying figures, reference number 1 globally designates a unit for packaging containers 2 produced continuously from a tubular wrapper 3. It should be specified that FIG. 1 schematically shows, by way of example, the unit 1 in which some technical details have been removed for better clarifying the general structure of the unit 1.

In detail, the unit 1 is constituted by means 4 for feeding a continuous strip 3*a* of paper material from which the tubular wrapper 3 is obtained, as shall be better explained hereinafter. The feeding means 4 are constituted by a reel 5 of the continuous strip 3*a* and by transmission rollers 5*a* adapted to feed the strip 3*a* along a predefined path. Downstream of the feeding means 4 is a forming member 6 able to join opposite longitudinal edges of the continuous strip 3*a* to define the tubular wrapper 3. The forming member 6, which is not described and illustrated in detail, is constituted by a series of sliding guides, respectively twisted to overturn at least one longitudinal edge of the strip 3*a* on the other and seal the edges together. The tubular wrapper 3 is then fed along a vertical direction A of the respective path, at a member 7 for filling the wrapper.

In greater detail, the tubular wrapper 3 has a respective upper opening corresponding to a portion of the belt 3*a*, not yet sealed, in which the incoherent material is dispensed. The filling member 7 is constituted by a dispensing nozzle 7*a* positioned at the opening of the tubular wrapper 3 and engaged with a respective conduit for containing the incoherent material. For example, if the incoherent material is constituted by a liquid, the nozzle 7*a* dispenses the liquid inside the tubular wrapper filling the latter from the lower portion to a predetermined height. Thus filled, the tubular wrapper passes by a forming device 8 which constructs the containers 2 from the tubular wrapper 3.

Figure 2:
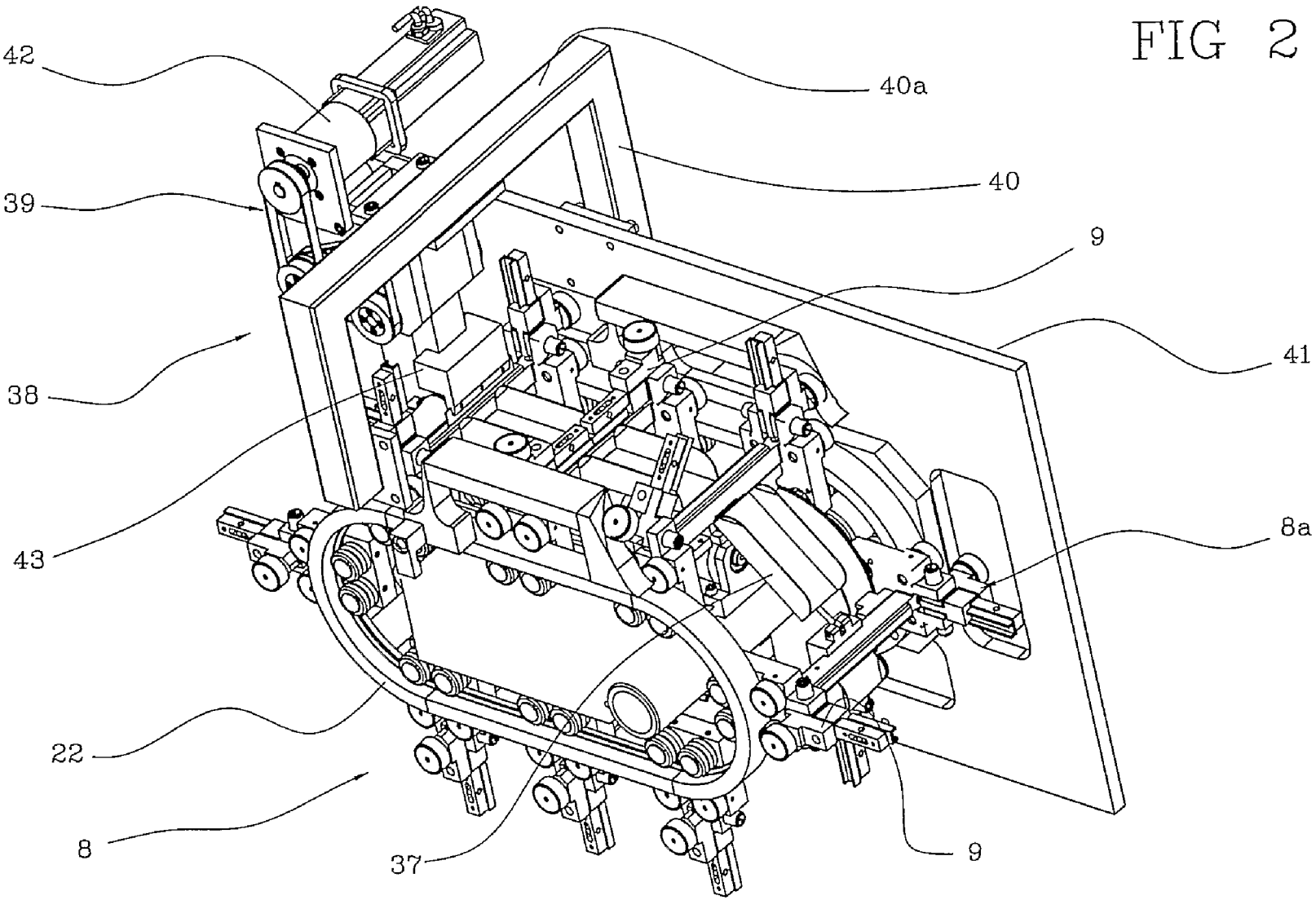
FIG. 2 is a perspective view of a forming device according to the present invention, schematically shown in FIG. 1.

The forming device 8, illustrated in detail in FIG. 2, is constituted by at least one support carriage 8*a* movable along a respective closed path. This path has substantially elliptical shape and is constituted by at least one active segment that is parallel and coincident with the vertical direction of advance A of the tubular wrapper 3, and by a passive segment opposite to the active segment.

Advantageously, the device 8 has a plurality of carriages 8*a* actuated along the path by respective actuating means 10 as shall be better described below. In detail, each carriage 8*a* is constituted by a pair of shoes 9 associated with a respective sealing base 11 at opposite ends 11*a* of the base. As further illustrated in the detail of FIG. 5 and FIG. 6, each shoe 9 has a body 12 having substantially parallelepiped conformation in which is defined an inner surface 12*a* engaged to one of the ends 11*a* of the base 11 and an outer surface 12*b* opposite to the inner surface 12*a*. At the outer surface 12*b* of the body 12 are operatively associated a plurality of sliding elements 13, preferably constituted by rotatable casters 13*a*. More in detail, each body 12 has three casters 13*a* rotatable about respective axes, transverse to the development of the active segment of the path. At least two of the three casters 13*a* are advantageously aligned to each other along the development of the path, whilst the remaining caster is positioned below the first two. Each body 12 also has an upper portion 12*c* positioned above the base 11 in which is obtained a seat 12*d* adapted to house a contrasting element 14.

Figure 11:
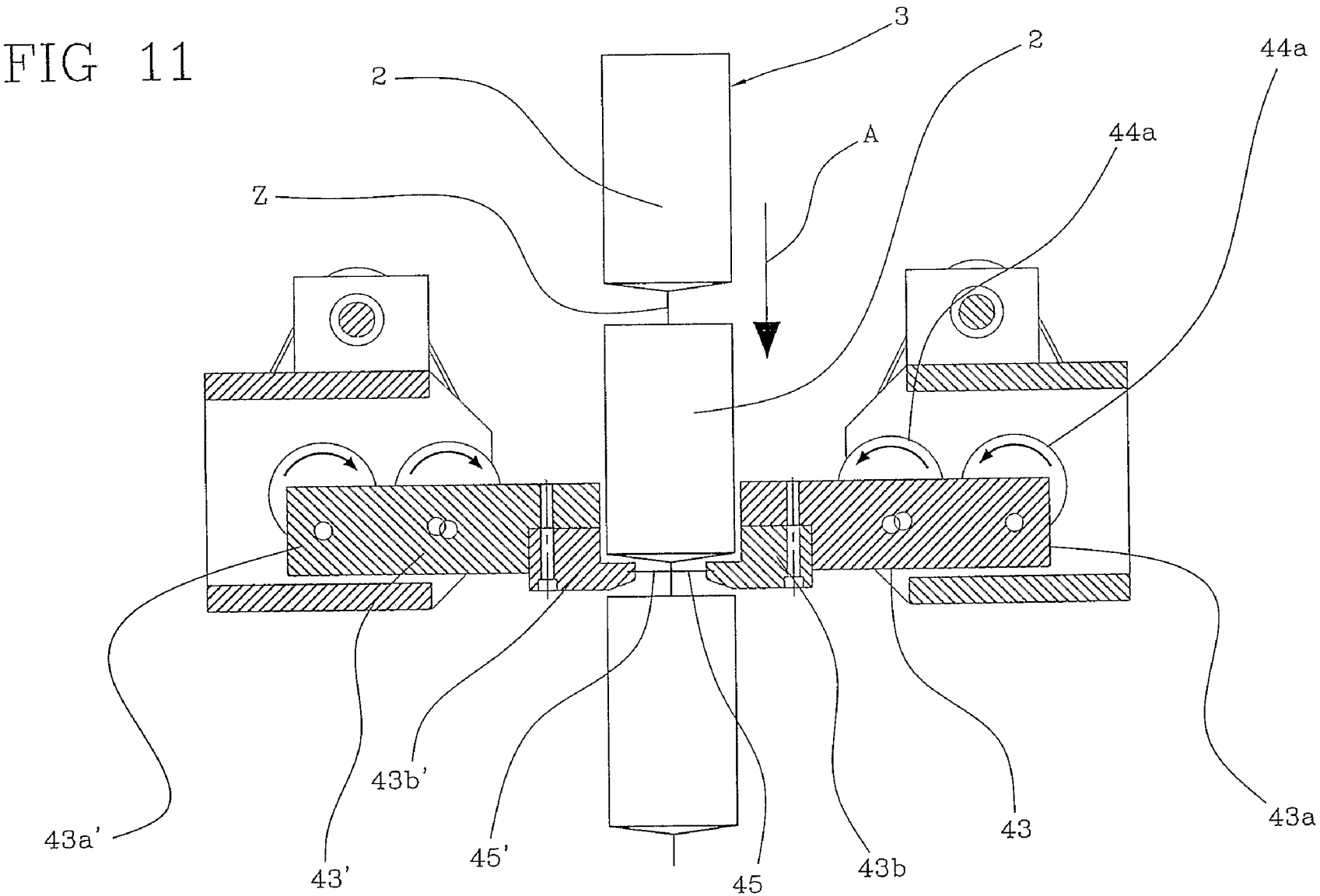
FIGS. 11, 12 and 13 respectively illustrated schematic side elevation views of additional variants of the construction detail of FIG. 10.
Figure 12:
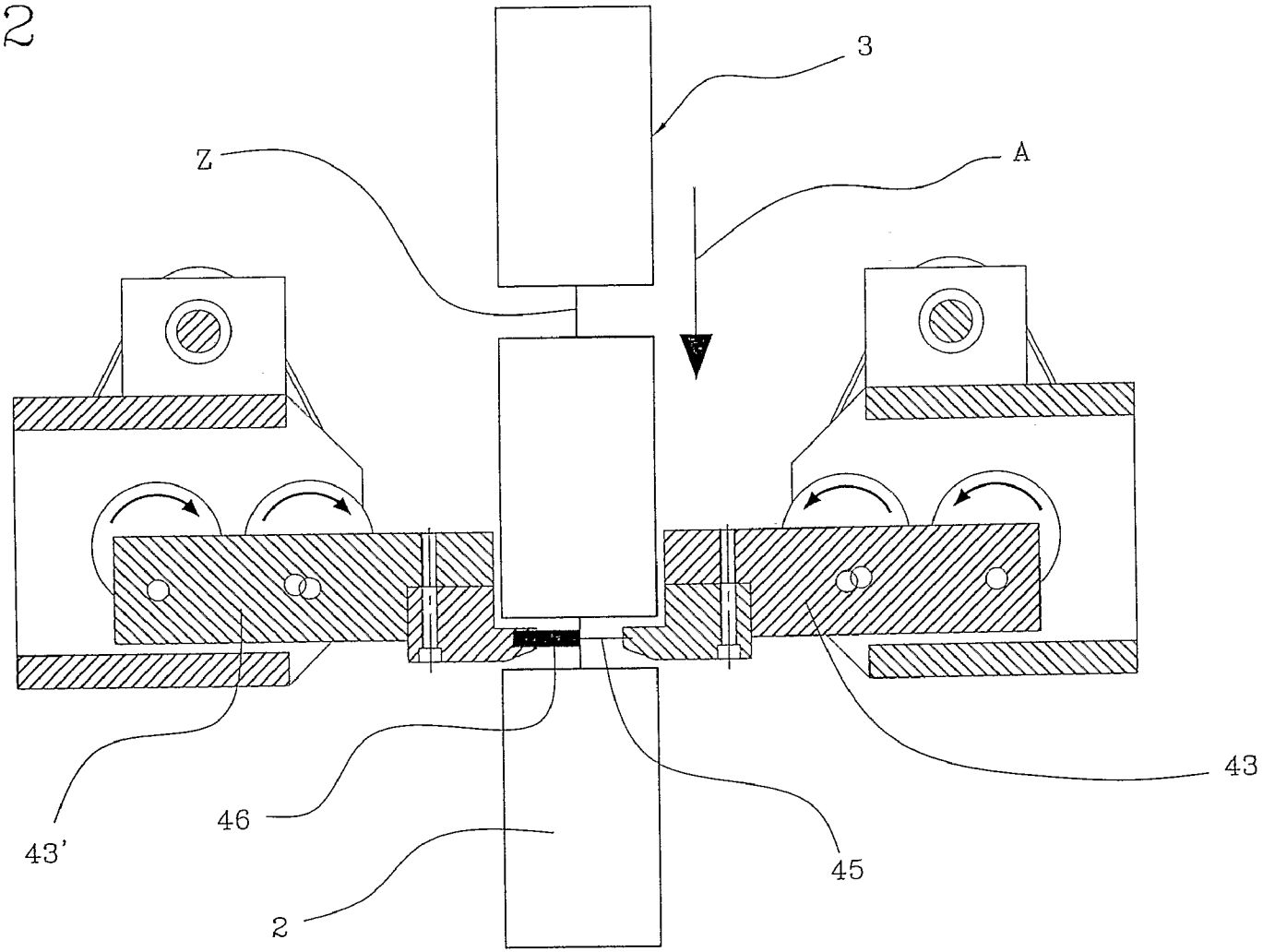
Figure 13:
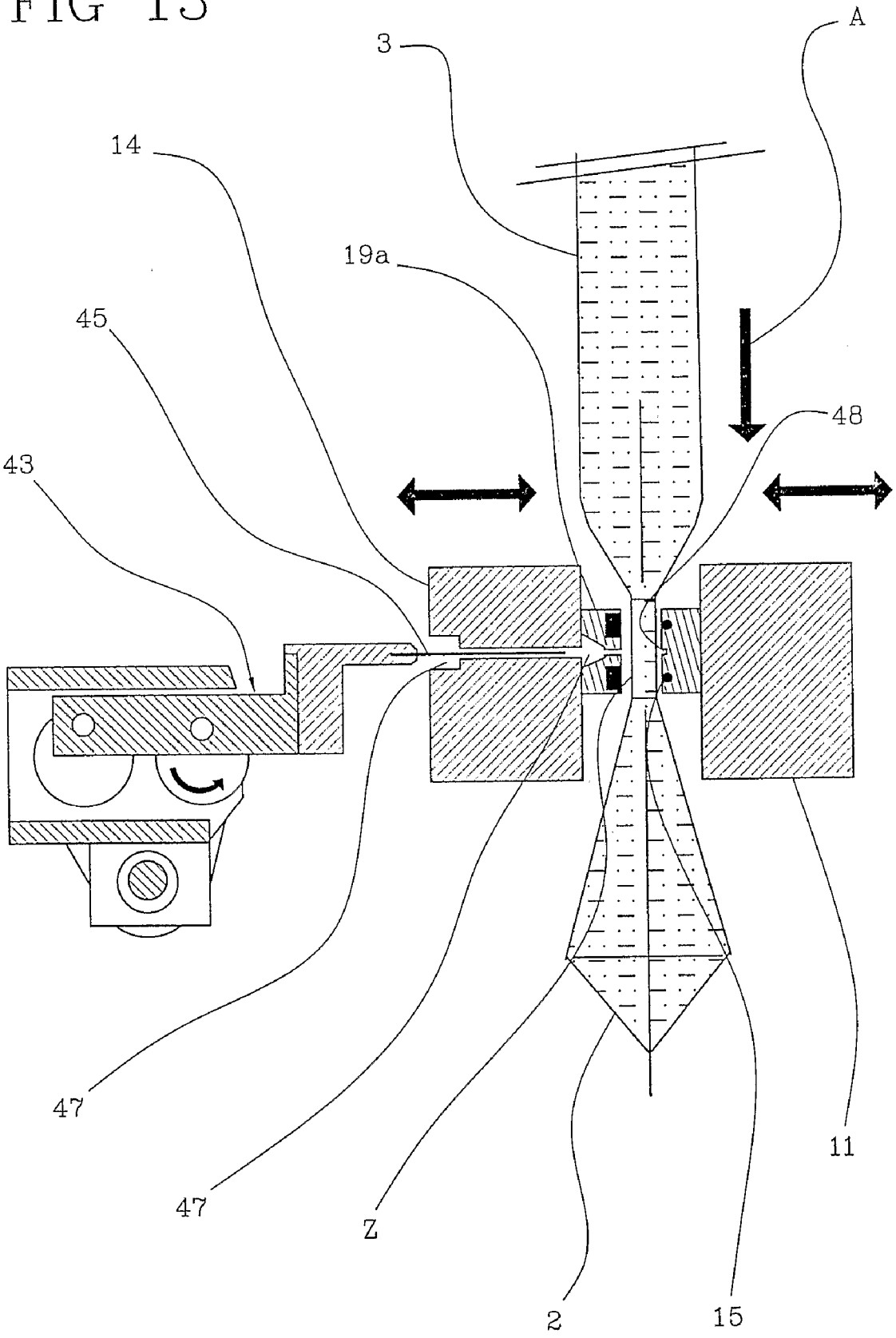

As mentioned above, between each shoe 9 a base 11 is provided having substantially parallelepiped conformation and developing along a respective longitudinal dimension, transverse to the aforementioned active segment. The sealing base 11 is adapted to be associated to a first lateral face of the tubular wrapper 3, at a seal region Z of the wrapper 3. It should be noted that the seal region Z, which is illustrated more clearly in FIGS. 11 through 13, is constituted by a segment that is transverse to the longitudinal development of the tubular wrapper 3 where a first lateral face of the wrapper 3 is joined with a second lateral face opposite to the first lateral face. In this way, each individual container 2 is defined between two seal regions Z. The sealing base 11 has a first surface 15 able to be associated to the first lateral face of the wrapper 3 and having longitudinal development corresponding to the seal region Z. Preferably, the first surface 15 has respective sealing means, not further described in detail. For example, said sealing means can be constituted by an electrically heated lamina, a radio frequency emitter, or an ultrasound emitter.

Figure 4:
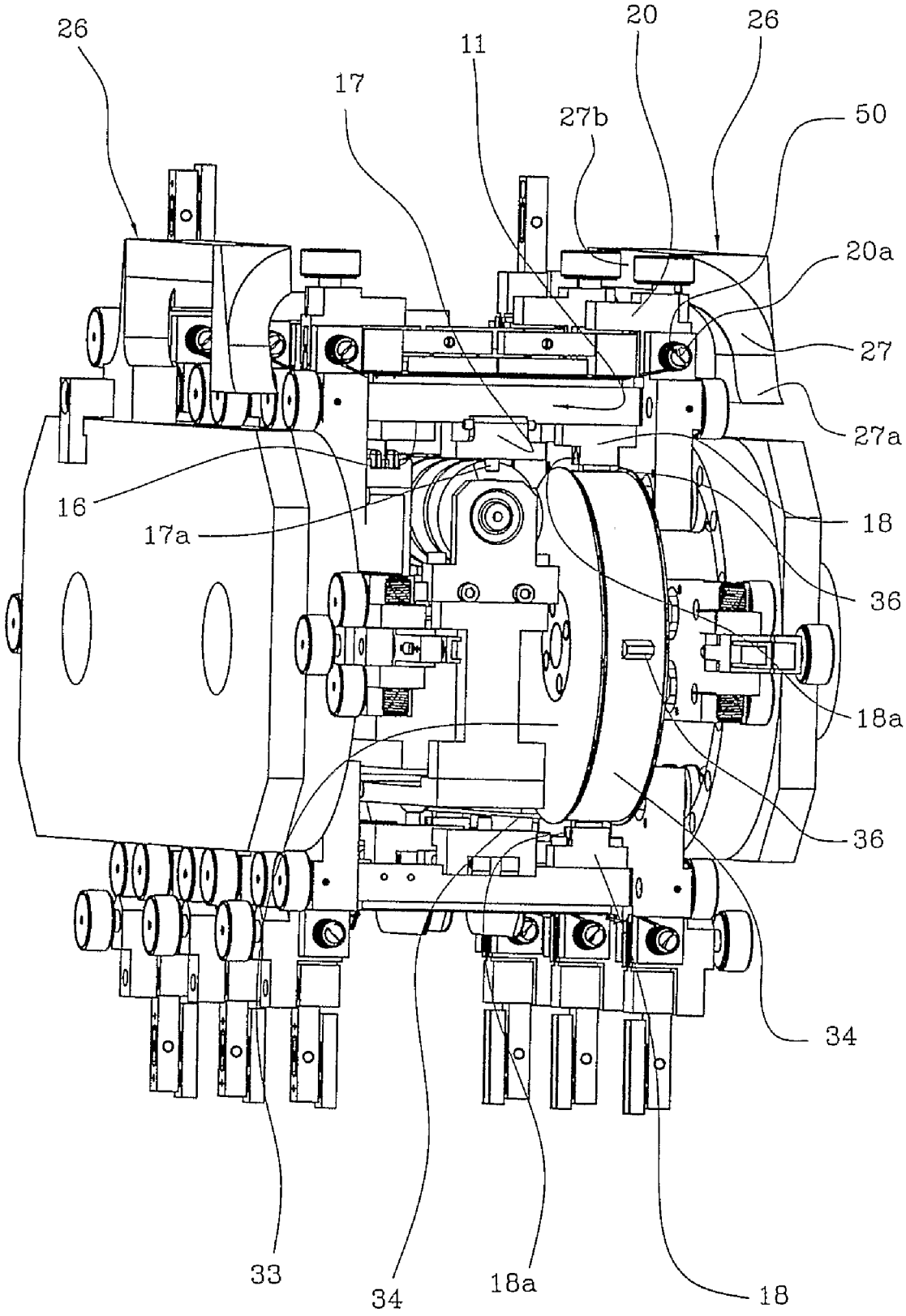
FIG. 4 is a perspective view of a construction detail of the forming device of FIG. 2.

As is better illustrated in FIG. 4, each sealing base 11 also has a second surface 16 opposite and parallel to the first surface 15. From the second surface 16, a first and a second projecting element 17, 18 are provided side by side to each other. The first projecting element 17 has an insertion pivot 17*a* which extends transversely to the planar surface of the second surface 16 below the base 11. The second projecting element 18 has an opening 18*a* obtained on the element 18 and oriented below the base 11.

As previously mentioned, each body 12 of the respective shoes 9 has an upper portion 12*c* in which is obtained the seat 12*d* able to house the contrasting element 14. Each shoe 9 has a contrasting element 14 movable between a first closed position in which the contrasting element 14 approaches the base 11 and abuts on the second lateral face of the tubular wrapper 3 at the seal region Z, and a second position in which the contrasting element 14 moves away from the base 11.

In detail, each carriage 8*a* has two contrasting elements 14 associated at respective opposite ends 15*a* of the first surface 15 and each of which extends from the respective end 15*a* to a median portion of the first surface 15. The contrasting elements 14 of each carriage 8*a* are movable symmetrically between the first position, in which they are side by side along a same longitudinal axis (see for example FIGS. 4 and 5), and the second position in which they face each other and are transverse to the longitudinal development of the first surface 15 (see for example FIG. 3).

In yet more detail, each contrasting element 14 includes a bar 19 having a respective active surface 19*a* which, in the first position of the contrasting element 14, is able to abut on the first surface 15 of the base 11. Advantageously, the active surface 19*a* of the bar 19 can also have known sealing means, previously described in exemplifying fashion. The pressure exerted by the active surface 19*a* of the bar 19 and of the first surface 15 of the base 11 determines the pressing of the seal region Z of the tubular wrapper and the consequent sealing thereof.

Each bar 19 also has an end portion 20 positioned at an end 11*a* of the base 11. In particular, the end portion 20 is inserted rotatably in the seat 12*d* obtained in the upper portion 12*c* of the respective body 12. In still further detail, the end portion 20 is inserted in the upper portion 12*c* by means of a through pivot 20*a*, in such a way as to make the bar 19 rotatable about an axis that is perpendicular to the planar development of the first surface 15 of the base 11. Additionally, at each end portion 20 of the respective bar 19, a sliding element 13 is positioned above the bar 19. This sliding element, too, is constituted by a caster 13*a* rotatable about a respective axis, transverse to the longitudinal development of the respective bar 19.

The means 10 for actuating the carriages 8*a* have at least one support guide 22 to guide the carriages 8*a* along the closed path. Advantageously, as shown in the accompanying figures, two support guides 22 are provided, parallel and at a distance from each other, each of which is associated to each shoe 9 of each carriage 8*a*. In greater detail, each guide 22 includes a rail extending along a substantially elliptical path, corresponding to the development of the closed path. The casters 13*a* of each body 12 rotate on the respective rail, in such a way as to slide along the close path.

Figure 3:
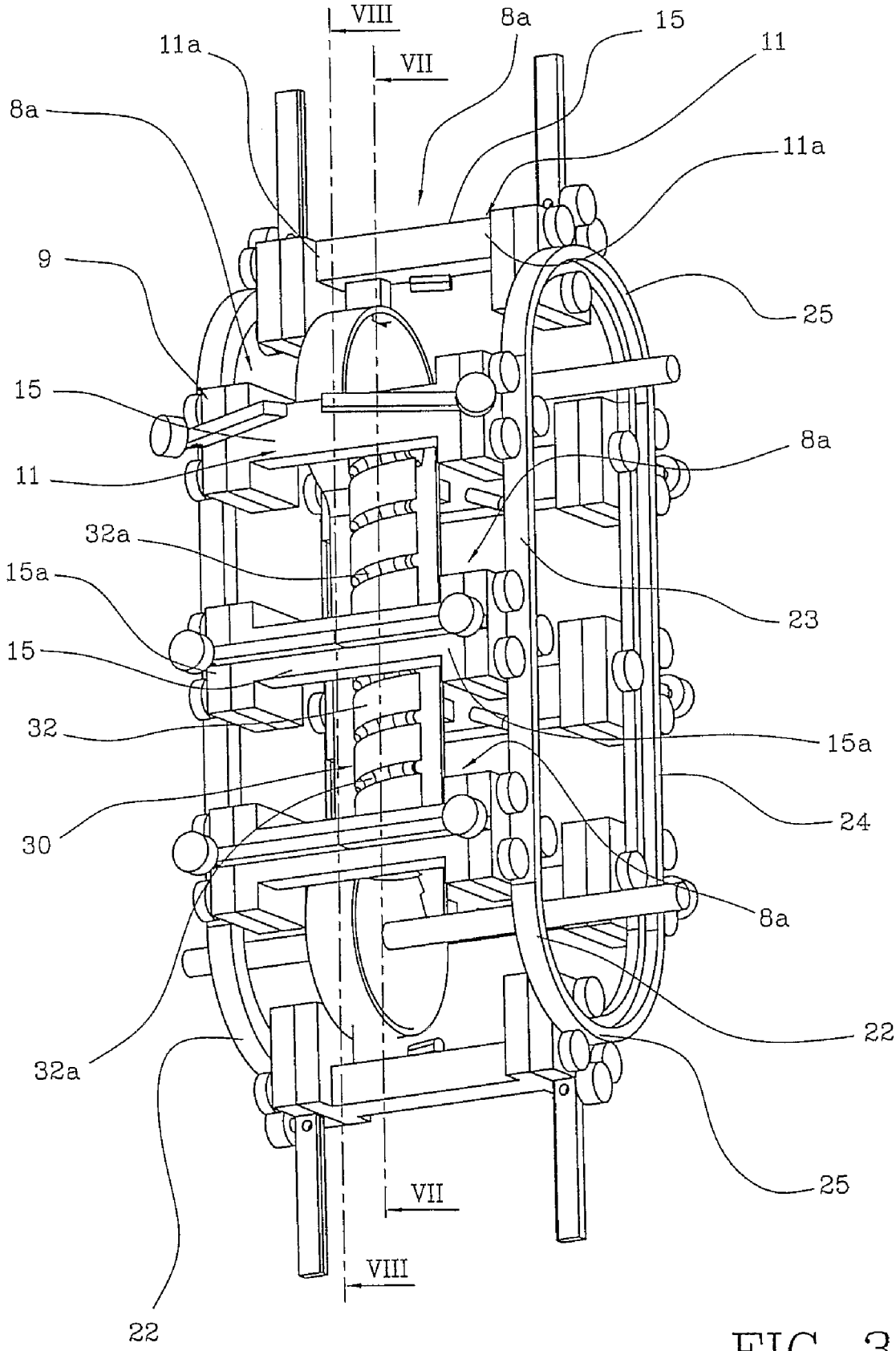
FIG. 3 is a perspective, schematic view of the device illustrated in FIG. 2 with some parts removed to better show others.
Figure 5:
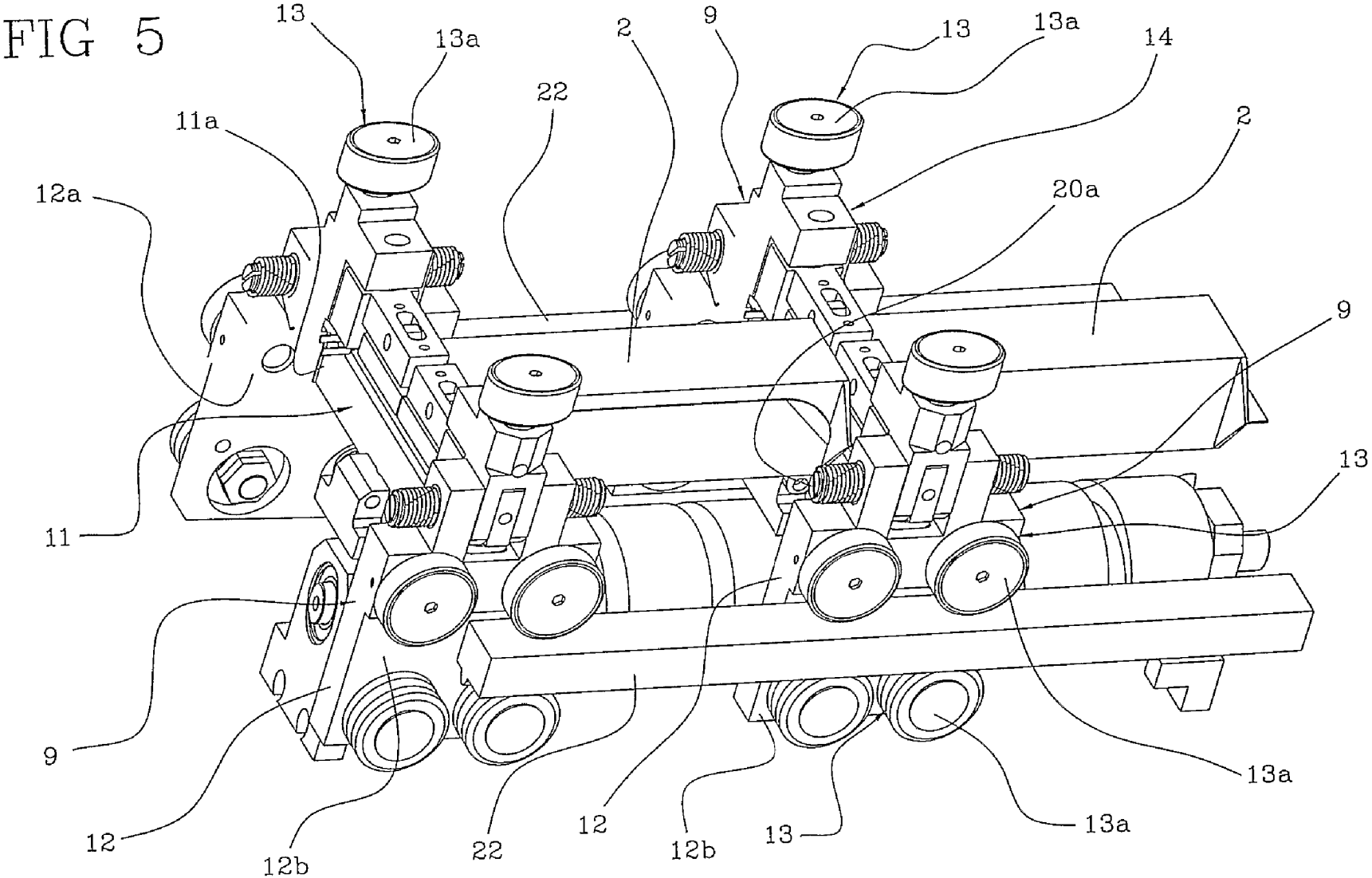
FIG. 5 is a perspective view of a construction detail of the forming device.
Figure 6:
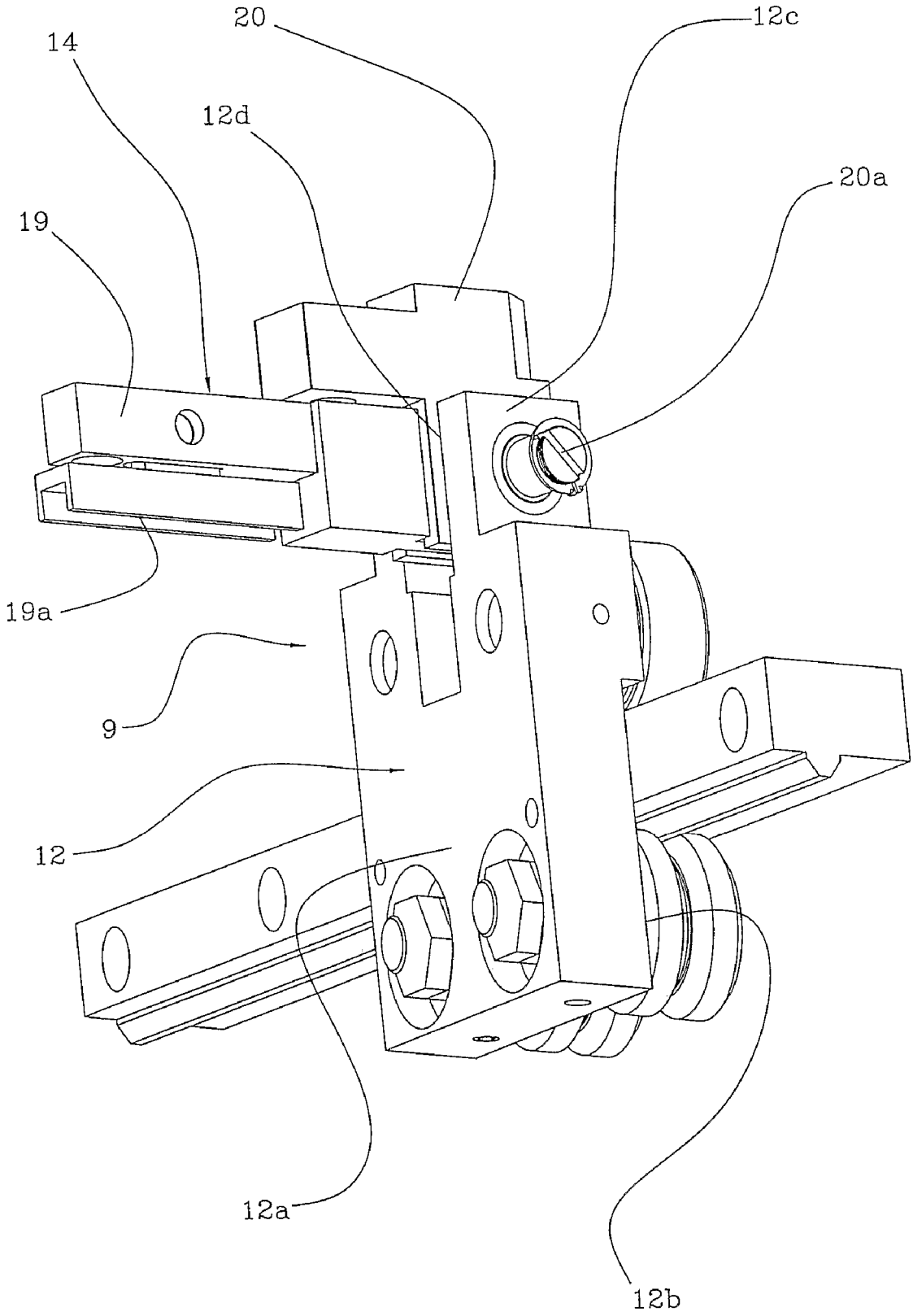
FIG. 6 is a perspective view of an additional construction detail of the forming device.

As shown in detail in FIG. 5, each rail is interposed between the sliding elements 13 in such a way that for each body 12 of the shoe 9 two casters 13*a* are positioned aligned to each other on an upper surface of the rail and that a third caster 13*a* is placed on a lower surface of the rail. With reference to FIG. 3, it should be noted that each rail includes a primary rectilinear portion 23 parallel to the direction of advance A of the tubular wrapper and corresponding to the active segment of the closed path. Moreover, each rail has a secondary rectilinear portion 24 opposite and parallel to the primary rectilinear portion 23 and two arched junction portions 25 between the primary 23 and secondary 24 rectilinear portions. The secondary rectilinear portion 24 and the arched portions 25 constitute the passive segment of the closed path. Each guide 22 also has a side panel 26 positioned at the primary rectilinear path 23 and able to be engaged with the bar 19 to actuate the contrasting elements 14 between their first and second position.

In detail, the side panels 26, each of which is associated with a respective guide 22, include a contrasting surface 27, twisted and facing the carriages 8*a*. In yet closer detail, as better shown in FIG. 4, each contrasting surface 27 has a first portion 27*a* parallel to the planar development of the first surface 15 of the base 11, and a second portion 27*b* consecutive to the first portion 27 and transverse to the planar development of the first surface 15. Each caster 13*a* engaged on the respective end portion 20 of the corresponding bar 19 rotates on the contrasting surface 27 to rotate the bar 19 between the first and second position. Advantageously, when each caster 13*a* associated to the respective bar 19 rotates on the first portion 27*a* of the contrasting surface 27, the corresponding contrasting element 14 is in the respective second position in which the contrasting element 14 is detached from the respective base 11. During the advance of the carriage 8*a* the caster 13*a* associated to the respective bar slides on the twisted portion rotating the contrasting element 14 about the pivot 20*a*, until the caster 13*a* is able to slide on the second portion 27*b* of the contrasting surface 27*b*, and the corresponding contrasting element 14 is positioned in the respective second position in which the contrasting element 14 approaches the base 11.

Figure 7:
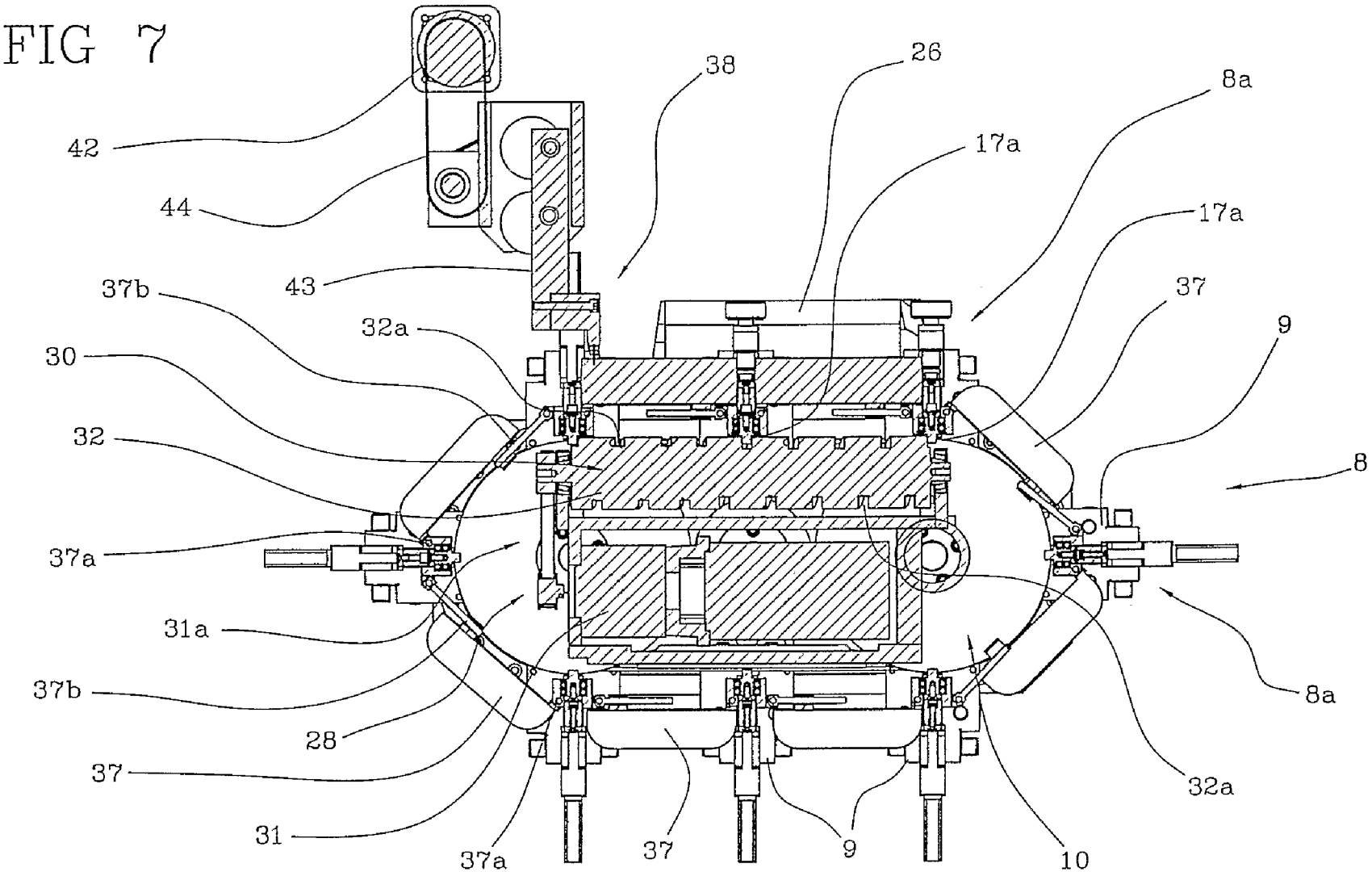
FIG. 7 is a side elevation view partially sectioned along the lines VII-VII of the forming device shown in FIG. 3.

The actuating means 10 also have a first motor member 28 to actuate the carriages 8*a* along the active segment of the close path and a second motor member 29 to actuate the carriages 8*a* along the passive segment opposite to the active segment. As shown in FIG. 7, the first motor member 28 has a transport element 30 whose longitudinal extent is parallel to the active segment and associated with a motor 31. Both the motor 31 and the transport element 30 are interposed between the guides 22. Preferably, the transport element 30 is constituted by an auger 32 rotatable about a longitudinal axis parallel to the active segment.

More in particular, the auger 32 includes a cylindrical body having an outer surface in which is obtained a helical cavity 32*a*. When a carriage is positioned in the active segment, the insertion pivot 17*a* of the first projecting element 17 of the respective base 11 is inserted in the helical cavity 32*a*. Advantageously, as a result of the rotation of the auger 32, the pivot 17*a* slides along the helical cavity 32*a* driving the base 11 and the respective pair of shoes 9 along the active segment corresponding to the longitudinal development of the auger 32. The auger 32 is set in rotation by the motor 31 through appropriate motion transmission members 31*a*, not further described in detail. For example, said transmission members 31 can include a pair of pulleys associated respectively with the drive shaft and to an end of the auger and linked to each other by a belt.

It should be specified that the accompanying figures show an auger 32 having the respective helical cavity 32*a* with constant pitch, in order to maintain constant the actuation velocity of every carriage 8*a* along the active segment for the same angular velocity of the auger 32. However, a helical cavity 32*a* with non-constant pitch may be provided to vary the actuation velocity of the carriages 8*a*. For example, at one end of the auger 32 placed at a final portion of the active segment, the helical cavity 32*a* may have a pitch (distance between a point of the cavity and the next symmetrical point) that is greater than the rest of the auger 32. In this way, when the carriage 8*a* slides along the greater pitch of the cavity 32*a*, the carriage 8*a* increases its speed because of the greater distance of the pitch.

Alternatively, variations in the size of the pitch of the helical cavity 32*a* may be provided to quicken or slow the travel of the carriages 8*a* in the active segment.

Figure 9:
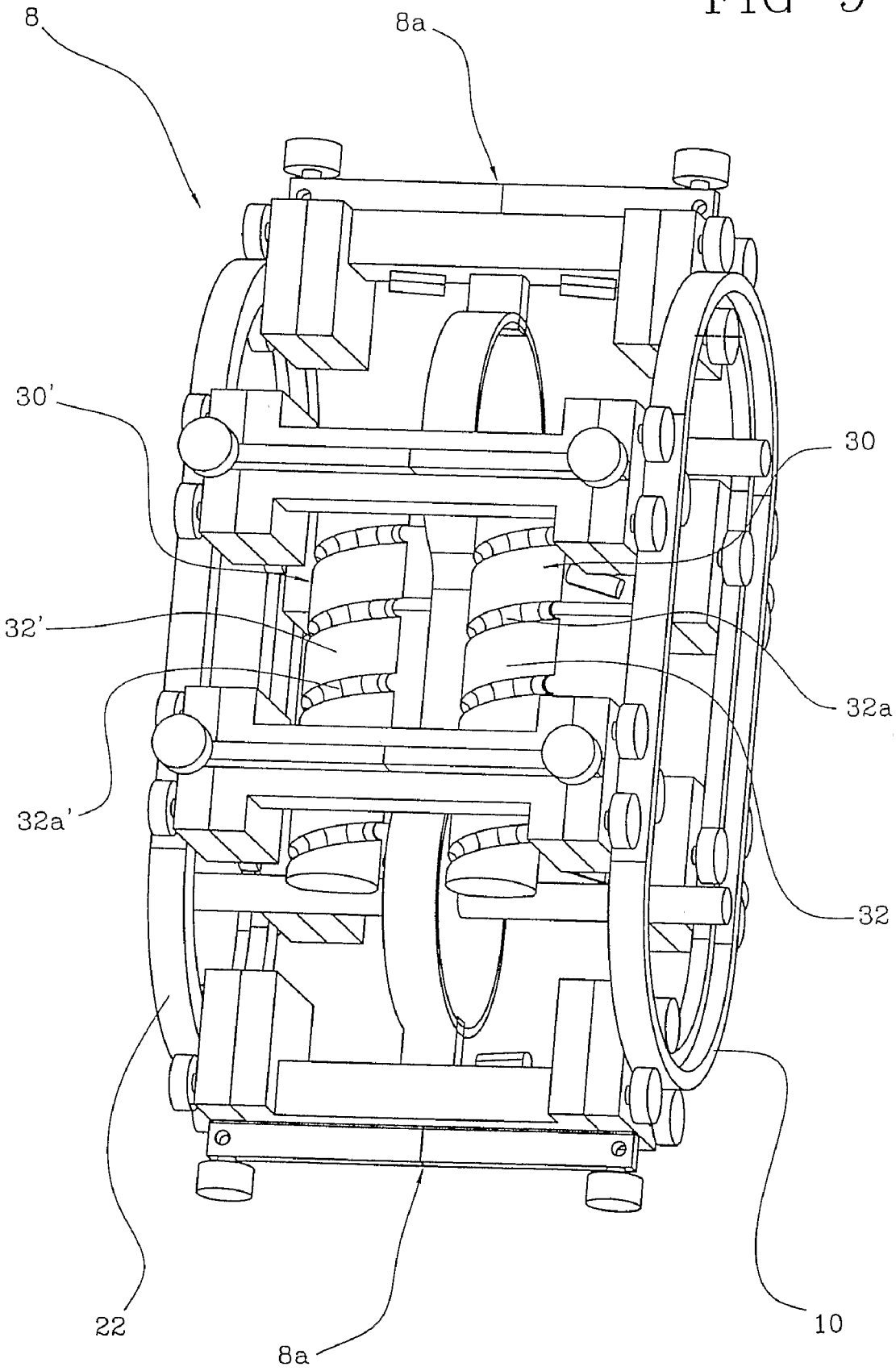
FIG. 9 is a perspective schematic view of the device shown in FIG. 2 with some parts removed to better show others, in accordance with a second embodiment.

In a further alternative embodiment shown in FIG. 9, the first motor member 28 is constituted by a first and a second transport element 30 and 30' set side by side. In particular, the two transport elements 30 and 30' respectively include a first and a second auger 32 and 32' extending longitudinally, mutually parallel and parallel to the active segment. The first and the second auger 32 and 32' have, respectively, the helical cavities 32*a* and 32*a'* with mutually different pitch, i.e., one of the cavities has a greater distance between one point and its next symmetrical point that the other helical cavity.

The bases 11 belonging to respective carriages 8*a* have the first projecting element 17 positioned at the first or at the second auger 32 and 32'. In this way, the base 11 of a carriage 8*a* has the respective pivot 17*a* associated to the helical cavity 32*a* of the first auger 32 and the subsequent carriage 8*a* has the respective pivot 17*a* associated to the helical cavity 32*a'* of the second auger 32'. In this way, every carriage 8*a* can be actuated along the active segment at a different speed from the subsequent and from the previous carriage 8*a*.

Alternatively, a first and a second auger 32 and 32' can be provided, with respective helical cavities having the same pitch. The two augers are actuated independently of each other and with different velocity to differentiate the velocity of advance of each carriage 8*a*.

Figure 8:
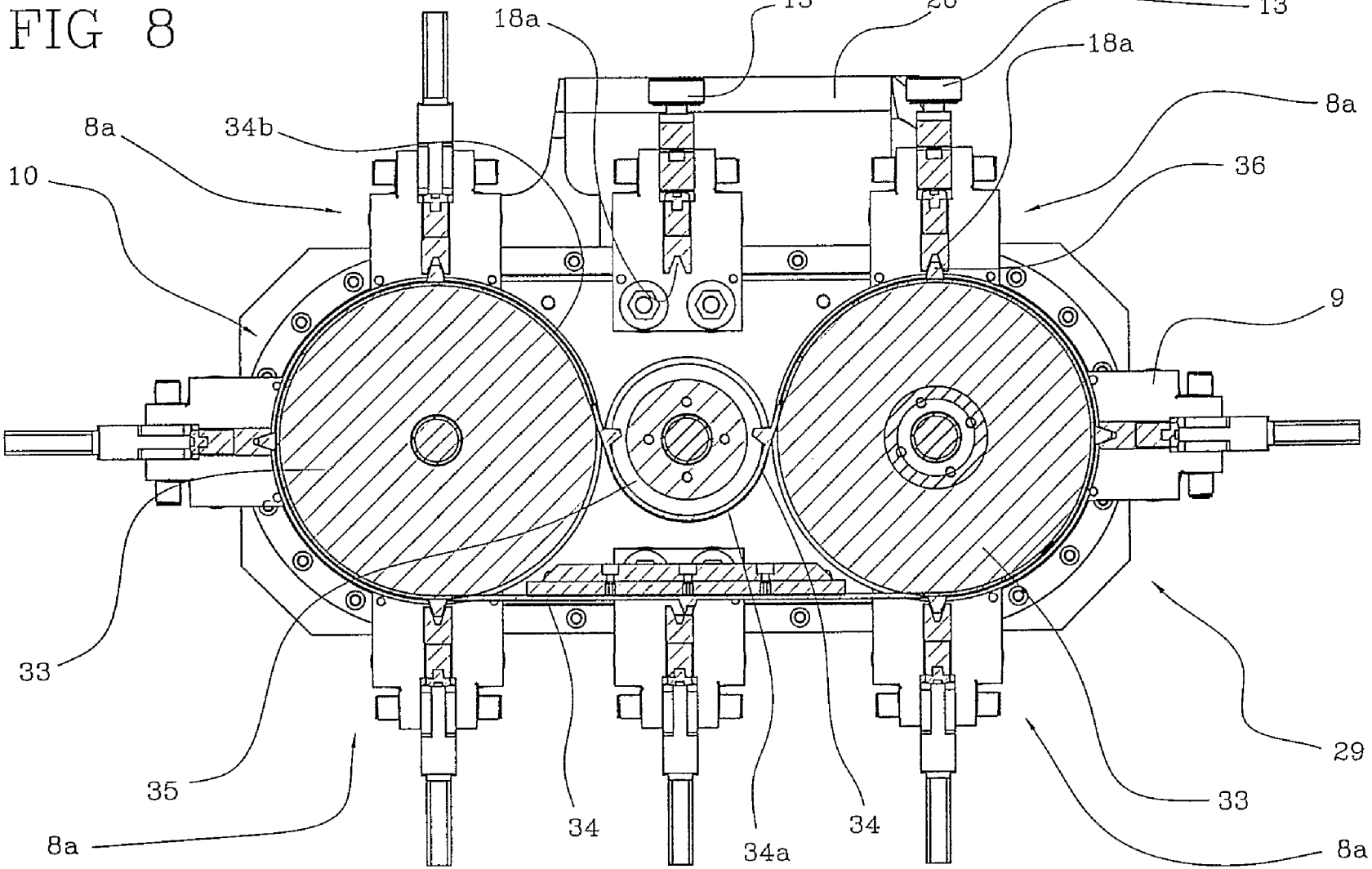
FIG. 8 is an additional side view partially sectioned along the lines VIII-VIII of the device shown in FIG. 3.

With reference to FIG. 8, the second motor member 29 has at least two pulleys 33 positioned mutually side by side, each pulley being positioned at an arched portion of junction 25.

The pulleys 33 rotate about respective axes, mutually parallel and parallel to the planar development of the first surface 15 of each base 11. The pulleys 33 are respectively associated to a belt 34 positioned substantially along the passive segment to transport each carriage 8*a* along the passive segment. The second motor member 29 also has at least one transmission roller 35 of the belt 34 positioned between two pulleys 33 to distance the belt 34 from the first motor member 28.

In detail, the belt 34 has an inner surface 34*a* able to abut against the pulleys 33 and an outer surface 34*b* opposite to the inner surface 34*a* oriented towards the guides 22 and associated to the transmission roller 35. As shown in FIG. 8, the belt 34 slides along a substantially two-lobed closed path defining the passive segment. Additionally, the belt 34 has a plurality of engagement pivots 36, mutually equidistant and extending from the outer surface 34*b* of the belt 34 (also visible in FIG. 4). The transmission roller 35 which can abut against the outer surface 34*b* of the belt 34, has respective seats able to receive the engagement pivots 36 during the actuation of the belt 34. The engagement pivots 36 are advantageously shaped complementarily to the openings 18*a* obtained in the respective second projecting elements 18 of the bases 11 and able to be inserted into the openings 18*a*.

In detail, when one of the carriages 8*a* is positioned at the passive segment and then placed at the belt 34, an engagement pivot 36 is inserted into the respective opening 18*a* and drives, by the motion of the belt 34, the respective carriage 8*a* along the passive segment. Advantageously, as shown in FIGS. 2 and 7, the device 8 also has a plurality of walls 37 each of which is associated between two successive shoes 9 for abutting to a flank of the tubular wrapper 3 transverse to the first and second lateral face. In particular, the walls 37 have substantially plate-like development and their planar development is transverse to the planar development of the first surface 15 of each base 11. Preferably, a pair of walls 37 are provided, respectively associated between each carriage 8*a* and the adjacent carriage 8*a*.

As shown in FIG. 7, each wall 37 has a first end 37*a* pivotally engaged to a corresponding shoe 9 at the second surface 16 of the base 11, and a second end 37*b* opposite to the first. The second end 37*b* has a pivot, slidable within a slot whose development is parallel to the closed path and which is obtained in a projection of the respective shoe 9. In this way, the adjacent carriages 8*a* can approach or move away from each other making the pivot in the slot.

Each pair of walls 37 then abuts respective opposite flanks of the tubular wrapper to give a substantially parallelepiped shape to each individual container 2 during the sealing of the region Z. Moreover, by virtue of the walls 37 associated to the shoes 9, it should be noted that the walls 37 are positioned abutting the opposite flanks of the wrapper 3 only when the shoes are positioned along the active path.

Figure 10:
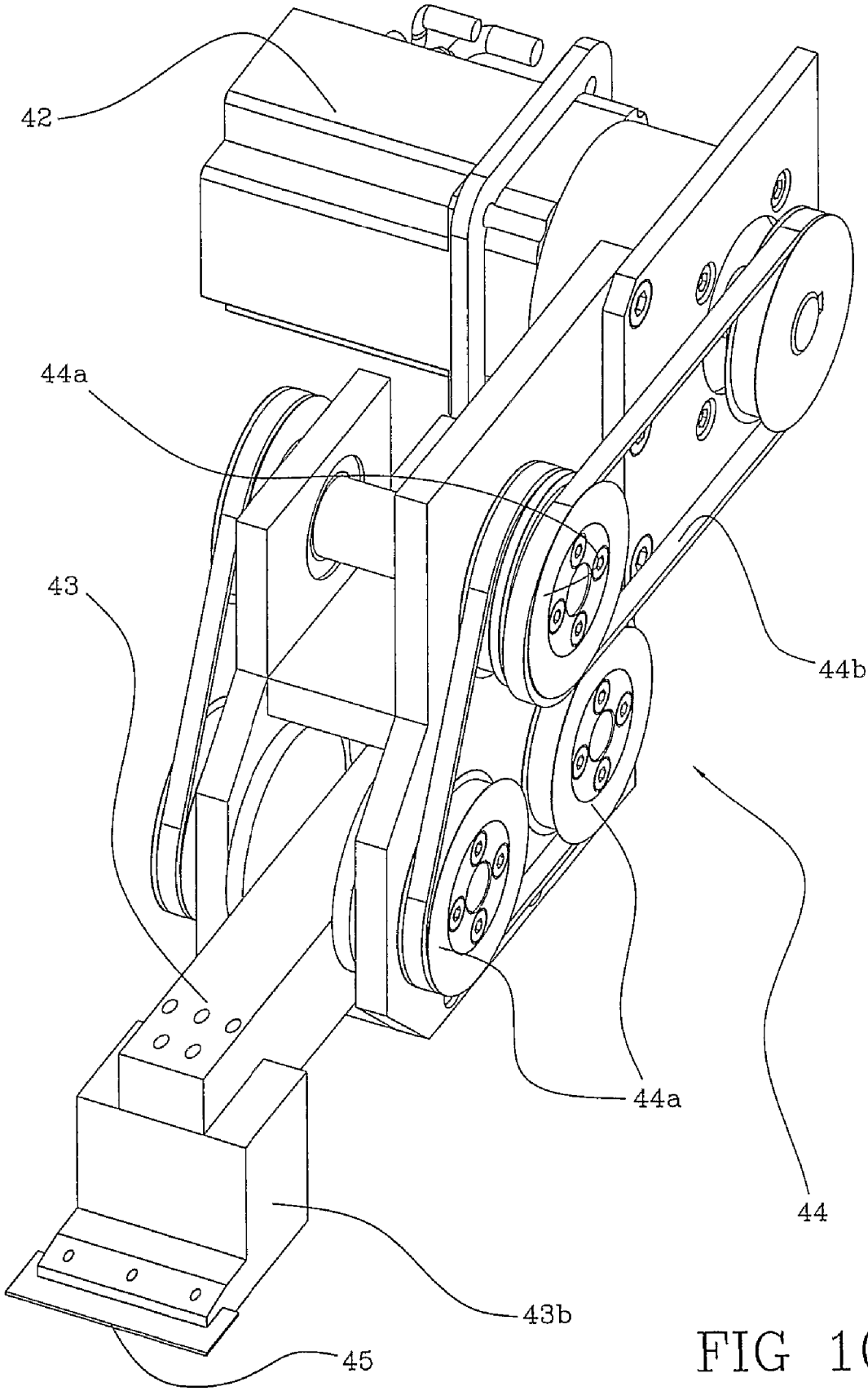
FIG. 10 is a perspective view of a construction detail of the device shown in FIG. 2.

The forming device 8, lastly, has means 38 for cutting the tubular wrapper 3, which are operatively active at the seal region Z to obtain the individual containers. The cutting means 38 has at least one separator device 39 illustrated in detail in FIG. 10 and positioned downstream of the active segment relative to the direction of advance A of the tubular package 3. The separator device 39 is constituted by a support frame 40 secured to a load-bearing structure 41 of the forming device 8 (see FIG. 2). The support frame 40 is constituted by an upright 40*a* developing above the tubular wrapper 3 transversely to the direction of advance A of the tubular wrapper 3. On the upright 40*a* is secured a motor 42, not described further in detail, operatively associated with an arm 43 movable transversely to the direction of advance A between a first position in which the arm 43 moves from the tubular wrapper 3 and a second position in which the arm 43 approaches to the seal region Z of the wrapper 3. In particular, the arm 43 has substantially longiform conformation and has a first end 43*a* positioned at the motor 42 and associated thereto by a transmission member 44. The transmission member 44 includes a connecting rod-crank kinematic mechanism with three pulleys 44*a* set in rotation by the motor 42 by a belt 44*b*. The first end 43*a* is pivotally engaged to two of the three pulleys 44*a* (see FIG. 10) at an off-centre point of the pulleys.

In this way, the rotation of the pulleys 44*a* determines the rectilinear reciprocating movement of the entire arm 43 between the respective first and second position. The arm 43 also has a second end 43*b*, opposite to the first end 43*a*, in which is a housing seat of a blade 45 whose longitudinal development is parallel to the longitudinal development of the first surface 15 of each base 11. Advantageously, when the arm 43 is in the second position, the blade 45 is positioned above the seal region Z in order to cut it longitudinally. After the transverse cut of the wrapper 3, the blade 45 abuts against the first surface 15 of the base 11 positioned below the blade 45. It should be noted that, when the blade 45 approaches the wrapper 3 to cut the seal region Z, the contrasting elements 14 positioned on the respective base 11 are moved away from the first surface 15. In this way, the arm 43 can freely approach the tubular wrapper 3 without being hindered by the contrasting elements 14.

In accordance with an alternative embodiment shown in FIG. 11, the separator device 38 is positioned downstream of the guides 22 along the direction of advance A. Two arms 43 and 43' are provided, facing each other and with each of them having the respective blade 45, 45'.

Still with reference to FIG. 11, it should be noted that the tubular wrapper 3 is positioned between the two arms 43, 43' which are actuated in mutually independent fashion to move closer or farther away from each other. Advantageously, when the arms 43, 43' are movable to approach each other, the respective blades 45 and 45' abut against each other in such a way as to cut the tubular wrapper 3 transversely at the respective seal region Z.

In the embodiment variant of FIG. 12, the second end of the arm 43' has a contrasting support 46, adapted to abut against the blade 45 of the other arm 43. The contrasting support constitutes a fixed support of the blade 45 and is advantageously provided with a recess (not shown in the figure) inside which is housed the blade 45.

FIG. 13 shows an additional embodiment variant of the separator device 38. Only one arm 43 as described above is present and it is positioned at the active segment above the side panels 26. Additionally, in accordance with this alternative solution, the bars 19 of the contrasting elements 14 have a through opening 47 which extends longitudinally along each bar 19. When the bars 19 both approach the first surface 15 of the respective base 11, the through openings 47 of the bars 19 are mutually side by side and aligned in such a way as to define a single opening whose longitudinal development matches the longitudinal development of the seal region Z. The respective base 11 has a recess 48 obtained on the first surface 15 and developing along the longitudinal development of the surface 15. Advantageously, as shown in FIG. 13, the recess 48 is placed at the openings 47 of the bars 19 when the bars 19 abut against the region Z to be sealed. When the contrasting elements 47 abut against the region to be sealed Z, the blade 45 can be inserted into the openings 47 of the bar 19. In this way, the blade 45 passes through the openings 47 and cuts the region Z longitudinally until it inserts itself into the recess 48.

The operation of the packaging unit 1 and of the respective forming device 8, described above in prevalently structural sense, is the following.

With reference to FIG. 1, the continuous strip 3*a* is fed from the respective reel 5 towards the forming member 6 of the tubular wrapper 3. The forming member 6 folds at least one longitudinal edge of the continuous strip 3*a* on the other and longitudinally seals the region of superposition of the edges. In this way, the tubular wrapper 3 is defined and fed along the vertical direction A by appropriate members. The tubular wrapper 3 fed vertically has a respective upper opening defined by the respective longitudinal edges, not yet sealed. Advantageously, the filling member 7 delivers the incoherent material inside the tubular wrapper 3 through the upper opening. In this situation, the tubular wrapper 3 positioned vertically is filled only up to a certain height. The tubular wrapper 3 thus filled passes at the forming device 8 along the active segment of the closed path.

Starting from a carriage 8*a* which passes from the passive segment to the active segment, it should be noted that the first surface 15 of the base 11 abuts against the first lateral face of the wrapper 3. The respective pivot 17*a* is positioned in the helical cavity 32*a* and by the rotation of the auger 32 the pivot slides along the cavity 32*a* driving the respective base 11 and the shoes 9 along the active segment. The sliding elements 13 of the respective shoes 9 slide along the primary rectilinear portions 23 of the respective guides 22 at the same velocity of advance as the tubular wrapper 3. When the shoes 9 are at the side panels 26, the respective contrasting elements 14 are positioned in the corresponding first position.

In particular, when the carriage 8*a* arrives at the side panels 26, each sliding element 13 positioned on the respective bar 19 slides on the first portion 27*a* of the contrasting surface and subsequently, following the twisted profile of the contrasting surface 27, it advances until reaching the second portion 27*b*. In this way, the sliding elements 13 positioned on the bars 19 move from a position in which they rotate on the first portion 27*a* about an axis that is parallel to the planar development of the first surface 15 of the base, to a position in which they rotate on the second portion 27*b* about an axis that is perpendicular to the planar development of the first surface 15. Consequently, the bars 19 that are associated to the respective sliding elements 13 rotate about the through pivot 20*a* for positioning above the second lateral face to press the second lateral face. Because of the pressing of the bars 19 against the base 11, the lateral faces of the wrapper 3 are sealed and the sealing region Z obtained during the continuous advance of the wrapper 3 along the direction A.

When the carriage 8*a* advances outside the side panels 26, the contrasting elements return to the second position in which the bars 19 are moved away from the base 11. Advantageously, moreover, a spring 50 (shown in FIG. 4), positioned about the pivot 20*a*, determines the return of the contrasting element 14 in the second position. It should be noted that advantageously, multiple carriages 8*a* are positioned simultaneously on the active segment in such a way that at least two successive carriages 8*a* are at the side panels 26. The tubular wrapper 2 can be sealed simultaneously in multiple parts or individually at different times.

With reference to the embodiment in which the pitch of the cavity 32*a* is variable, successive carriages 8*a* move faster in the initial segment. In this way, a displacement of the respective seal regions Z which are mutually approached. Advantageously, because of this longitudinal squashing of the tubular wrapper 3 the individual containers 2 are deformed to a specific shape. For example, during the longitudinal squashing of the wrapper 3, the flanks of the wrapper 3 are deformed towards the exterior in such a way as to adhere to the walls 37. In this situation, the containers 2 are formed with parallelepiped shape in which the flanks constituted opposite lateral walls.

In the embodiment of FIG. 9, each carriage 8*a* is associated in alternating fashion to one of the two augers 32, 32'. Each pair of carriages 8*a*, which are respectively associated to the first or to the second auger 32, 32', move with different velocities. For example, if the helical cavities have different pitch (or if the helical cavities are identical but the respective augers are fed in mutually independent fashion) the carriage 8*a* associated to the auger 32 having the helical cavity 32*a* with greater pitch (auger fed at higher velocity) moves faster than the carriage 8*a* that precedes it in such a way as to move the seal regions Z to each other and to define the squashing of the container 2. When the contrasting element 14 return in the second position, the carriage 8*a* is positioned at the separator device 38. At this point the arm 43 is actuated towards the base 11 until the respective blade 45 abuts against the seal region Z to cut the same. As a result of the transverse cut of the tubular wrapper 3, the blade 45 bears on the first surface 15 of the base 11 and subsequently the arm 43 is moved away from the base 11. Advantageously, the containers 2 previously filled and formed are obtained as a result of the transverse cut.

In the embodiments illustrated in FIGS. 11 and 12, the tubular wrapper 3 is made to advance sealed outside the guides 22 to allow the two arms 43 to approach each other and to cut the wrapper along the region Z to define the containers 2.

In accordance with the embodiment of FIG. 13, the separator device 13 is positioned above the side panels 26 and the arm 43 approaches the wrapper 3 when the contrasting elements 14 are still pressing and sealing the wrapper 3. The blade 45 passes through the openings 47 obtained on the bars 19 to cut the region Z whilst it is sealed. Advantageously, at the end of the sealing operation, i.e., when the contrasting elements 14 move away from the tubular wrapper 3, the container 2 is already detached from the remainder of the wrapper 3. Once the transverse seal is completed, the carriage 8*a* passes from the active segment to the passive segment. The pivot 17*a* reaches the end of its travel in the helical cavity 32*a* and the base 11 is positioned at one of the two pulleys 33. One of the engagement pivots 36 positioned on the belt 34 is then inserted into the opening 18*a* driving the carriage 8*a* along the passive segment in the two arched portions 25 and in the secondary rectilinear portion to return the pair 9 to the active segment.

The present invention solves the problems noted in the prior art and achieves the proposed object.

First of all, the forming device 8 allows accomplishing the sealing and the forming of the containers 2 during the travel of the tubular wrapper 3. Because of the movement along the active segment of the carriages 9 in synchrony with the advance of the wrapper 3 along the direction A, the bars 19 and the respective base 11 do not rub on the wrapper 3. Advantageously, the seals in the region Z and the forming of each individual container 2 are accomplished correctly.

It should also be noted that the described device has very small bulk and a particularly simple structure. This advantage is due to the presence of a single pair of guides 22 adapted to support and guide the shoes 9.

Advantageously, using the contrasting elements 14 movable on the respective bases 11, additional elements positioned in front of the forming device 8 and adapted to press and seal the wrapper 3 are eliminated. For this reason, the forming device 8, in addition to having reduced size allows a marked reduction in construction and commercialisation costs and easy accessibility in case of failure.

Lastly, another advantage is provided by the ability to give a particular shape to the container 2 during the sealing operations.

The invention claimed is:

1. A device for forming containers produced continuously from a tubular wrapper fed along a substantially vertical direction of advance, comprising:

at least one support carriage movable along a respective closed path which closed path has at least one active segment parallel to said direction of advance;

a sealing base engaged to said support carriage for being actuated on a first lateral face of said tubular wrapper at a sealing region of the wrapper;

a contrasting element mounted on the support carriage and movable between a first closed position, in which the contrasting element approaches said base and abuts against a second lateral face of the tubular wrapper opposite to the first lateral face at the sealing region, and a second position in which the contrasting element is movable away from said base (11);

at least one supporting guide to guide the support carriage along said closed path;

a first motor member to actuate the support carriage along said active segment;

a second motor member to actuate the support carriage along a passive segment of the closed path opposite to said active segment; and means for cutting said tubular wrapper operatively active at said sealing region to obtain said containers.

2. Device as claimed in claim 1, wherein said sealing base has a first surface transverse to said direction of advance and has means for sealing said tubular wrapper.

3. Device as claimed in claim 2, wherein said cutting means comprises a separator device having:

a support frame secured to a load-bearing structure;

an arm movable transversely to said direction of advance between a first position in which it is moved away from said tubular wrapper and a second position in which it is approached to the seal region of said tubular wrapper;

a blade, parallel to the first surface of the base, engaged to said arm, said blade being able to abut against the first surface in the second position of said arm to cut said tubular wrapper; and a motor secured to said frame and engaged to said arm.

4. Device as claimed in claim 2, comprising two contrasting elements coupled to said sealing base at opposite ends of the first surface; said contrasting elements extending from said opposite ends of the first surface to a median portion of the first surface and being movable symmetrically between a first position in which said contrasting elements are aligned along a same longitudinal axis and a second position in which said contrasting elements face each other and are transverse to the first surface.

5. Device as claimed in claim 4, wherein each contrasting element has a bar having an active surface able to abut against said first surface of the base in the first position of the contrasting element; said bar further having an end portion pivotally engaged at one end of the base about a respective axis, transverse to the development of the first surface of said base.

6. Device as claimed in 5, wherein each bar further comprises sealing means positioned on the active surface of the bar.

7. Device as claimed in claim 5, wherein each end portion of the respective bar has a sliding element positioned above the bar.

8. Device as claimed in claim 7, wherein said sliding element comprises at least one caster slidable about a respective axis, transverse to the first surface of the base.

9. Device as claimed in claim 1, comprising a plurality of support carriages.

10. Device as claimed in claim 9, wherein each support carriage comprises a pair of shoes, each pair of shoes being engaged to a corresponding sealing base at respective opposite ends.

11. Device as claimed in claim 10, wherein each shoe has a body having an inner surface engaged to one of said ends of the sealing base, and at least one sliding element operatively engaged to the at least one supporting guide, and supported on an outer surface of the body opposite to the inner surface.

12. Device as claimed in claim 11, wherein said body has a plurality of sliding elements supported on the outer surface of said body.

13. Device as claimed in claim 12, wherein said sliding elements are constituted by casters rotatable about an axis that is parallel to the first surface of said base.

14. Device as claimed in claim 11, wherein each body of the respective shoes also has an upper portion positioned above said first surface of the base; each end portion of the respective bars being rotatably inserted into a seat obtained in the upper portion of the respective body.

15. Device as claimed in claim 10, comprising two supporting guides, parallel to and distanced from each other, each of which is engaged with one shoe of each support carriage.

16. Device as claimed in claim 15, wherein each guide has a rail having elliptical shape and defining said closed path, each rail having a primary rectilinear portion parallel to said direction of advance of the tubular wrapper and corresponding to said active segment of the closed path, a secondary rectilinear portion opposite and parallel to said primary rectilinear portion, two arched junction portions between said primary rectilinear segment and secondary rectilinear portion, said secondary rectilinear portion and arched portions corresponding to said passive segment of the closed path, said rail being interposed between the sliding elements positioned on the outer surface of each body.

17. Device as claimed in claim 16, wherein each supporting guide has a side panel positioned at said primary rectilinear path for being coupled to the sliding elements positioned on the respective bars to actuate the bars between the respective first and second position.

18. Device as claimed in claim 17, wherein each side panel has a twisted contrasting surface having a first portion parallel to the first surface of the base and a second portion transverse to the first surface; each caster being slidable on said contrasting surface.

19. Device as claimed in claim 18, wherein in the second position of the contrasting element the respective caster positioned on the bar is slidable on the first portion of the contrasting surface and the respective axis of rotation is parallel to the first surface of the base, and in the first position of the contrasting element, the respective caster is able to slide on the second portion of the contrasting surface and the respective axis of rotation is transverse to the first surface of the base.

20. Device as claimed in claim 16, wherein said first motor member comprises a transport element extending parallel to said active segment and positioned below said primary rectilinear portion; and a motor engaged to said transport element.

21. Device as claimed in the claim 20, wherein each base further comprises a first projecting element from a second surface of the base opposite to said first surface and having an insertion pivot extending transversely to said active segment below the base to be engaged to said transport element.

22. Device as claimed in claim 21, wherein said transport element has an auger able to rotate about a respective longitudinal axis corresponding to said active segment; said insertion pivot of each base being able to be inserted into a helical cavity obtained on the outer surface of said auger to move each shoe along the primary rectilinear portion.

23. Device as claimed in claim 16, wherein said second motor member comprises: at least two pulleys able to rotate about respective axes, parallel to each other and parallel to the first surface; and a belt associated to said pulleys and movable along said passive path.

24. Device as claimed in claim 23, wherein said belt has a plurality of engagement pivots extending externally from the belt and equidistant from each other; each engagement pivot being able to be inserted into an opening obtained in a second projecting element projecting from a second surface of the base opposite to said first surface to drive the respective support carriage along said passive segment.

25. Device as claimed in claim 23, wherein said second motor member further comprises at least one transmission roller of the belt positioned between said pulleys to distance the belt from said first motor member.

26. Device as claimed in claim 10, further comprising a plurality of walls each engaged to two consecutive shoes, said wall abutting against a respective flank of the tubular wrapper transverse to the first and second lateral face.

* * * * *